US006386297B1

(12) United States Patent
Cooley et al.

(10) Patent No.: US 6,386,297 B1
(45) Date of Patent: May 14, 2002

(54) METHOD AND APPARATUS FOR DETERMINING POTENTIAL ABRASIVITY IN A WELLBORE

(75) Inventors: Craig Hodges Cooley, South Ogden, UT (US); David Alexander Curry, Stonehaven (GB); Leroy William Ledgerwood, III, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/511,617

(22) Filed: Feb. 23, 2000

Related U.S. Application Data

(60) Provisional application No. 60/121,344, filed on Feb. 24, 1999.

(51) Int. Cl.[7] ..... E21B 12/02

(52) U.S. Cl. ..... 175/39; 175/50; 702/9

(58) Field of Search ..... 702/9, 6, 11; 175/39, 175/40, 50; 73/152.02, 152.03, 152.43, 152.44, 152.45

(56) References Cited

U.S. PATENT DOCUMENTS

| | | | | |
|---|---|---|---|---|
| 4,507,735 A | | 3/1985 | Moorhead | 364/422 |
| 4,852,399 A | | 8/1989 | Falconer | 73/151.5 |
| 4,914,591 A | | 4/1990 | Warren et al. | 364/422 |
| 4,926,686 A | | 5/1990 | Fay | 73/151 |
| 4,928,521 A | | 5/1990 | Jardine | 73/151 |
| 4,953,147 A | * | 8/1990 | Cobb | 367/35 |
| 5,181,172 A | | 1/1993 | Whitten | 364/422 |
| 5,216,917 A | | 6/1993 | Detournay | 73/151 |
| 5,305,836 A | | 4/1994 | Holbrook et al. | 175/39 |
| 5,312,163 A | | 5/1994 | Hanamoto et al. | 299/1.8 |

(List continued on next page.)

FOREIGN PATENT DOCUMENTS

| | | |
|---|---|---|
| FR | 401119 A1 * | 12/1990 |
| WO | PCT/US00/04626 | 2/2000 |

OTHER PUBLICATIONS

R. Irrgang, C. Damski, S. Kravis, E. Maidla, Keith Millheim, "A Case–Based System to Cut Drilling Costs," Oct. 3–6, 1999.

(List continued on next page.)

*Primary Examiner*—David Bagnell
*Assistant Examiner*—Zakiya Walker
(74) *Attorney, Agent, or Firm*—Melvin A. Hunn

(57) ABSTRACT

A method is provided for generating an indicator of potential bit abrasion in a particular wellbore. Forensic wellbore data is obtained from at least one previously drilled wellbore which is determined to be comparable to the particular target wellbore. Typically, the comparable wellbore comprises an "offset" wellbore which is proximate the target wellbore, and which has similar geologic features. An inference engine computer program is provided which consists of executable program instructions. It is adapted to utilize a plurality of wellbore parameters, including the forensic wellbore data. The inference engine includes at least one rule matrix which defines a plurality of fuzzy sets. These fuzzy sets establish correspondence between the plurality of wellbore parameters and the indictor of potential bit abrasion. The inference engine computer program is loaded onto a data processing system. At least the forensic wellbore data is supplied as an input to the inference engine computer program. The data processing system is utilized to execute the program instructions of the inference engine computer program. This causes the application of the inputs to the inference engine computer program. The inference engine computer program produces as an output an indication of potential bit abrasion in the particular target wellbore.

46 Claims, 15 Drawing Sheets

U.S. PATENT DOCUMENTS

| | | | | | |
|---|---|---|---|---|---|
| 5,415,030 | A | | 5/1995 | Jogi | 73/151 |
| 5,416,697 | A | | 5/1995 | Goodman | 364/422 |
| 5,637,795 | A | | 6/1997 | Hale et al. | 73/152.01 |
| 5,660,239 | A | | 8/1997 | Mueller | 175/61 |
| 5,730,234 | A | | 3/1998 | Putot | 175/50 |
| 5,787,022 | A | | 7/1998 | Tibbitts et al. | 364/578 |
| 5,794,720 | A | | 8/1998 | Smith et al. | 175/40 |
| 5,842,149 | A | | 11/1998 | Harrell | 702/9 |
| 6,101,444 | A | * | 8/2000 | Stoner | 702/9 |

OTHER PUBLICATIONS

H.I. Bilgesu, L.T. Tetrick, U. Atmis, S. Mohaghegh, S. Ameri, "*A New Approach for the Prediction of Rate of Penetration* (*ROP*) *Values*," Oct. 23–24, 1997.

A. Slnor, T. M. Warren, "*Drag Bit Wear Model*," Jun. 1989.

W. Soemodihardjo, S. Rachmat, "*Application of an Expert System to Rotary Drilling Bit Selection*". (1991).

Hibbs, L.E., Jr., Lee, M., "Some Aspects of Wear of Polycrystalline Diamond Tools in Rock Removal Processes," Wear, vol. 46, 1978.

Glowka, D.A., Stone, C.M., "Effects of Thermal and Mechanical Loading and PDC Bit Life," SPE 13257, 1984.

Goodman, H., Gregory, D.H, Perrin, V.P., "Volumetric Formation Mechanical Property Characterization for Drilling Engineering Modeling Applications Using the Rock Mechanics Algorithm (RMA)," SPE 39266, Nov. 1997.

Galle, E.M, Wilhoit, J.C., "Stresses Around a Wellbore Due to Internal Pressure and Unequal Principal Geostatic Stresses," 36 Annual Fall Meeting of SPE, Oct., 1961.

Warren, T.M., Smith, M.B., "Bottomhole Stress Factors Affecting Drilling Rate at Depth," JPT, Aug. 1985.

Hanson, J., and Tibbitts, G.A., "Pore Pressure Ahead of the Bit," SPE 21916, 1991.

Kolle, J.J., "A Model Of Dynamic Confinement During Drilling in Pressurized Boreholes," International Journal of Rock Mechanics and Mineral Science, vol. 30, No. 7, pp. 1215–1218, 1993.

Plumb, R.A., "Influence of Composition and Texture on the Failure Properties of Clastic Rocks," Eurock '94, 1994.

McClintock, F.A., Agron, A.S., Mechanical Behavior Materials, Addison Wesley Publishing Co., Reading, Mass, 1966.

Ledgewood et al., International Search Report for WO 00/50735, Pub. Date Aug. 31, 2000.*

* cited by examiner $$s_1 = 2So(\cos\phi)/(1-\sin\phi) + s_3(1+\sin)/(1-\sin\phi)$$

BHP

Abrasivity Index
Rule Matrix

| Strength | Sand Content: NS | LS | MS | HS |
|---|---|---|---|---|
| LS | NA | NA | LA | MA |
| MS | NA | LA | MA | SA |
| HS | LA | MA | SA | SA |

FIG. 8

Abrasivity Index x 10, no units

TABLE 1
Abrasion Index Strategy

| Index Parameter | Potential Abrasion related parameters | Comments |
|---|---|---|
| Sand content<br>lithology identifier | Comments | Quartz sand grains are the prevalent abrasive mineral encountered while drilling for oil and gas wells. They are abrasive because of their high hardness.<br>(Mohs hardness = 7) |
| Insitu strength<br>sonic transit times<br>lithology identifier<br>porosity | Angle of internal friction and cohesion | Both of these are strength parameters that determine how tightly the sand grains are held in place under stressed conditions. |

METHOD AND APPARATUS FOR DETERMINING POTENTIAL ABRASIVITY IN A WELLBORE

This application claims the benefit of U.S. Provisional Application Serial No. 60/121,344, filed Feb. 24, 1999, entitled Method and Apparatus for Determining Potential Abrasivity in a Wellbore.

BACKGROUND OF THE INVENTION

1. Field of the Invention

The present invention relates in general to computer implemented processes for improving drilling operations, and in particular to a system and method for facilitating the selection and use of drill bits in order to minimize the negative impact of abrasivity of the earth formation.

2. Description of the Prior Art

Bit abrasion is an undesirable operating condition which impedes drilling operations. In general, drilling operations are performed in a manner which minimizes the possibility of the occurrence of bit abrasion. One factor which can be controlled is the selection of particular drill bits from a group of available drill bits. Certain bits may be less prone to abrasion under certain drilling conditions, while other bits are more prone to abrasion under certain drilling conditions.

SUMMARY OF THE INVENTION

It is one objective of the present invention to provide a new system, method, and apparatus for providing an indicator of potential bit abrasion in a particular wellbore, which utilizes an inference engine computer program which consists of executable instructions, and which is adapted to utilize a plurality of wellbore parameters as inputs, including forensic wellbore data, and which includes at least one rule matrix which defines a plurality of fuzzy sets which establish correspondence between the plurality of wellbore parameters and the indicator of potential bit abrasion.

It is another objective of the present invention to provide such an indicator of potential bit performance which provides an indication of the potential for undesirable abrasivity of earth formations.

It is another objective of the present invention to provide an indicator which may be utilized in selecting particular drill bits for use in a particular wellbore.

The foregoing and additional objectives are achieved as follows. A method is provided for generating an indicator of potential bit abrasion in a particular wellbore. Forensic wellbore data is obtained from at least one previously drilled wellbore which is determined to be comparable to the particular target wellbore. Typically, the comparable wellbore comprises an "offset" wellbore which is proximate the target wellbore, and which has similar geologic features. An inference engine computer program is provided which consists of executable program instructions. It is adapted to utilize a plurality of wellbore parameters, including the forensic wellbore data. The inference engine includes at least one rule matrix which defines a plurality of fuzzy sets. These fuzzy sets establish correspondence between the plurality of wellbore parameters and the indictor of potential bit abrasion. The inference engine computer program is loaded onto a data processing system. At least the forensic wellbore data is supplied as an input to the inference engine computer program. The data processing system is utilized to execute the program instructions of the e inference engine computer program. This causes the application of the inputs to the inference engine computer program. The inference engine computer program produces as an output an indication of potential bit abrasion in the particular target wellbore.

The above as well as additional objectives, features, and advantages will become apparent in the following description.

BRIEF DESCRIPTION OF THE DRAWINGS

The novel features believed characteristic of the invention are set forth in the appended claims. The invention itself however, as well as a preferred mode of use, further objectives and advantages thereof, will best be understood by reference to the following detailed description of the preferred embodiment when read in conjunction with the accompanying drawings, wherein:

FIG. 8 is a graphical representation of the preferred rule matrix utilized in the preferred embodiment of the present invention.

Table 1 a graph which represents factors which are considered in determining the abrasion index.

DETAILED DESCRIPTION OF THE INVENTION

Overview of Drilling Operations

Figure 1:
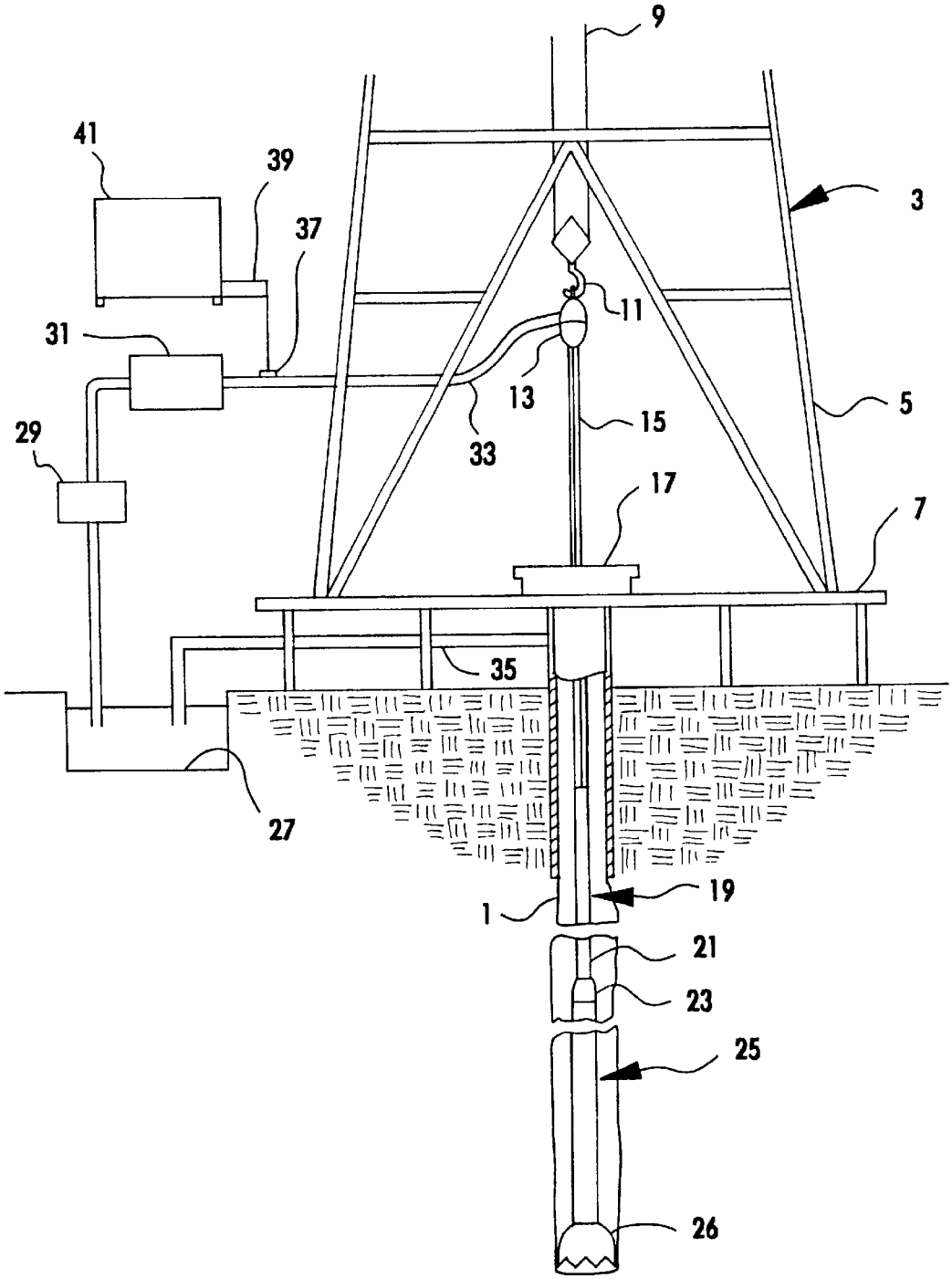
FIG. 1 is a simplified pictorial representation of drilling operations which may be conducted in accordance with the present invention.

FIG. 1 depicts one example of drilling operations conducted in accordance with the present invention with a downhole drill bit selected in accordance with the present invention based upon its suitability for the drilling conditions based at least in part upon its compatibility to a projected or anticipated potential for formation abrasivity as determined by an abrasivity index.

As is shown, a conventional rig 3 includes a derrick 5, derrick floor 7, draw works 9, hook 11, swivel 13, kelly joint 15, and rotary table 17. A drillstring 19 which includes drill pipe section 21 and drill collar section 23 extends downward from rig 3 into wellbore 1. Drill collar section 23 preferably includes a number of tubular drill collar members which connect together, including a measurement-while-drilling logging subassembly and cooperating mud pulse telemetry data transmission subassembly, which are collectively referred to hereinafter as "measurement and communication system 25".

During drilling operations, drilling fluid is circulated from mud pit 27 through mud pump 29, through a desurger 31, and through mud supply line 33 into swivel 13. The drilling mud flows through the kelly joint and an axial central bore in the drillstring. Eventually, it exists through jets which are located in downhole drill bit 26 which is connected to the lowermost portion of measurement and communication system 25. The drilling mud flows back up through the annular space between the outer surface of the drillstring and the inner surface of wellbore 1, to be circulated to the surface where it is returned to mud pit 27 through mud return line 35. A shaker screen (which is not shown) separates formation cuttings from the drilling mud before it returns to mud pit 27.

Preferably, measurement and communication system 25 utilizes a mud pulse telemetry technique to communicate data from a downhole location to the surface while drilling operations take place. To receive data at the surface, transducer 37 is provided in communication with mud supply line 33. This transducer generates electrical signals in response to drilling mud pressure variations. These electrical signals are transmitted by a surface conductor 39 to a surface electronic processing system 41, which is preferably a data processing system with a central processing unit for executing program instructions, and for responding to user commands entered through either a keyboard or a graphical pointing device.

The mud pulse telemetry system is provided for communicating data to the surface concerning numerous downhole conditions sensed by well logging transducers or measurement systems that are ordinarily located within measurement and communication system 25. Mud pulses that define the data propagated to the surface are produced by equipment which is located within measurement and communication system 25. Such equipment typically comprises a pressure pulse generator operating under control of electronics contained in an instrument housing to allow drilling mud to vent through an orifice extending through the drill collar wall. Each time the pressure pulse generator causes such venting, a negative pressure pulse is transmitted to be received by surface transducer 37. An alternative conventional arrangement generates and transmits positive pressure pulses. As is conventional, the circulating mud provides a source of energy for a turbine-driven generator subassembly which is located within measurement and communication system 25. The turbine-driven generator generates electrical power for the pressure pulse generator and for various circuits including those circuits which form the operational components of the measurement-while-drilling tools. As an alternative or supplemental source of electrical power, batteries may be provided, particularly as a back-up for the turbine-driven generator.

Figure 2:
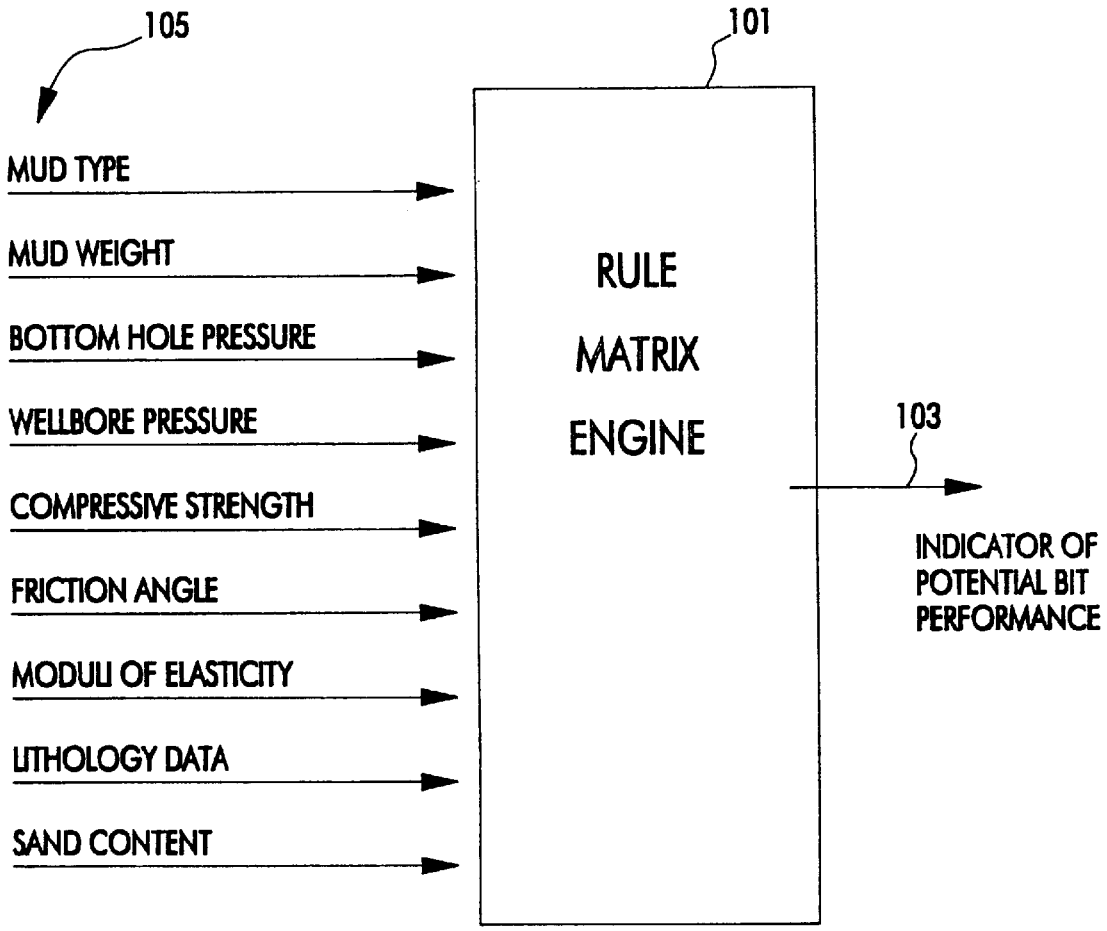
FIG. 2 is a block diagram representation of the types of wellbore parameters which may be utilized in accordance with the preferred and alternative embodiments of the present invention.

FIG. 2 is a block diagram pictorial representation of the broad concept of the present invention. As is shown, a rule matrix inference engine 101 produces as an output 103 an indicator of potential bit performance. A number of inputs 105 may be provided to the rule matrix inference engine 101. FIG. 2 depicts exemplary types of input data including mud type, mud weight, bottomhole pressure, wellbore pressure, compressive strength, friction angle, moduli of elasticity, lithology including sand content. In the preferred embodiment of the present invention, lithology data from offset wells is provided as one input. These wells are located proximate the target well, and likely traverse similar geologic formations at particular depths. The target well is expected to traverse the same types of formations at generally the same types of depths. Therefore, the offset wells provide a good indication of the sand content that is going to be drilled in the target well. In accordance with the preferred embodiment of the present invention, the likely strength of the formation of the target well is also provided as an input to the rule matrix inference engine 101. In the preferred embodiment, the rule matrix inference engine 101 receives these two types of input, one being derived from forensic log data and the other being projected strength and produces a numerical indicator of potential bit abrasion. In the preferred embodiment of the present invention, this data is used in the planning stages of the target wellbore in order to select the types of bits which are more suitable for particular drilling conditions which have a greater potential for bit balling. In other words, the rule matrix inference engine 101 is utilized in well planning operations in order to select particular bits which might perform better under projected abrasion conditions.

The rule matrix inference engine 101 of FIG. 2 is preferably constructed utilizing executable program instructions. Preferably, the program instructions are executed by a general purpose data processing system, such as that depicted in FIG. 3.

Figure 3:
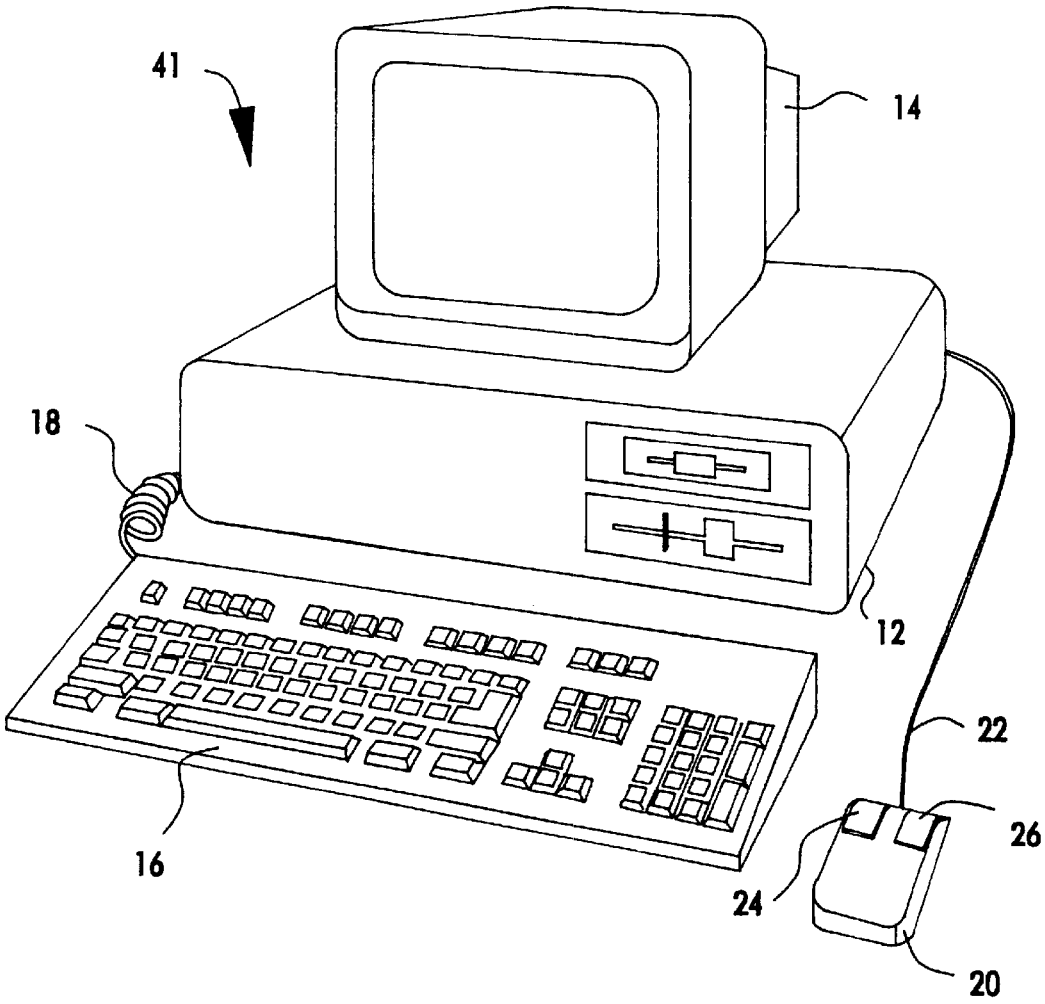
FIG. 3 is a pictorial representation of a data processing system.

With reference now to the figures and in particular with reference to FIG. 3, there is depicted a pictorial representation of data processing system 41 which may be programmed in accordance with the present invention. As may be seen, data processing system 41 includes processor 12 which preferably includes a graphics processor, memory device and central processor (not shown). Coupled to processor 12 is video display 14 which may be implemented utilizing either a color or monochromatic monitor, in a manner well known in the art. Also coupled to processor 12 is keyboard 16. Keyboard 16 preferably comprises a standard computer keyboard which is coupled to the processor by means of cable 18.

Also coupled to processor 12 is a graphical pointing device, such as mouse 20. Mouse 20 is coupled to processor 12, in a manner well known in the art, via cable 22. As is shown, mouse 20 may include left button 24, and right button 26, each of which may be depressed, or "clicked", to provide command and control signals to data processing system 41. While the disclosed embodiment of the present invention utilizes a mouse, those skilled in the art will appreciate that any graphical pointing device such as a light pen or touch sensitive screen may be utilized to implement the method and apparatus of the present invention. Upon reference to the foregoing, those skilled in the art will appreciate that data processing system 41 may be implemented utilizing a so-called personal computer.

In accordance with the preferred embodiment of the present invention, the rule matrix inference engine 101 (of FIG. 2) is constructed of executable instructions which are executed by a data processing system 41. What follows is a discussion of abrasivity, the abrasivity index which is generated in accordance with the present invention, a discussion of the variables believed to affect abrasivity, a description of the rule matrix, a description of fuzzy set methodology, a discussion of application of the abrasivity index to one test well, and a discussion of the contents of the computer implemented rule matrix inference engine 101 of FIG. 2.

Abrasion in General

Drilling strategies most often depend on the particular formations to be drilled and how they might affect the ultimate performance degradation of the bit. For example, the insertion point of PDC bits is often picked to be at the start of long shale or carbonate sequences, if possible, leaving any abrasive sand horizons to be drilled towards the end of the run. This provides for fast drilling in the overlying non abrasive rock while the dulling takes place at the end of the run in the sand. The result is an overall fast rate of penetration and good economics.

Absent dynamic effects and the well documented concomitant drill bit damage, cutter tooth abrasion or wear plays the largest role in bit performance degradation. Since this abrasion is highly dependent on the formations types, and the stress state under which these formations are drilled it seems reasonable to calculate an abrasivity index that will provide some measure of abrasiveness. This, in turn, could be used to pick insertion points for particular drill bit types or otherwise influence drilling strategy.

An Abrasivity Index

One goal of this work was to provide and index that ranges from 0 to 1 and that corresponds to the abrasion potential of a given formation. Preferably, this index is derived from wire line log data that is readily available.

An abrasivity index of '0' would correspond to absolutely no abrasive wear potential and '1' to an almost certain sever abrasive wear potential. Values above '0.5' would be deemed to be problematic. Further, the underlying algorithms should depend on the minimum number of formation parameters (independent variables) while still maintaining the ability to predict abrasion potential. Simplicity in this respect makes it easier to understand cause and affect relationships and facilitates adjusting the algorithm to field experience.

It is well known that some operating parameter such as bit rotary speed and weight can have dramatic effects on wear. In the preferred embodiment, operating parameters are not considered as part of this index since they are not always known ahead of time and since they can not always be prescribed with certainty. In the preferred embodiment, this index calculates a potential for abrasive wear based solely on formation (particularly sand content) and insitu stress data that has been obtained from wireline logs and other readily available sources.

Variables Believed to Affect Bit Wear

Figure 4:
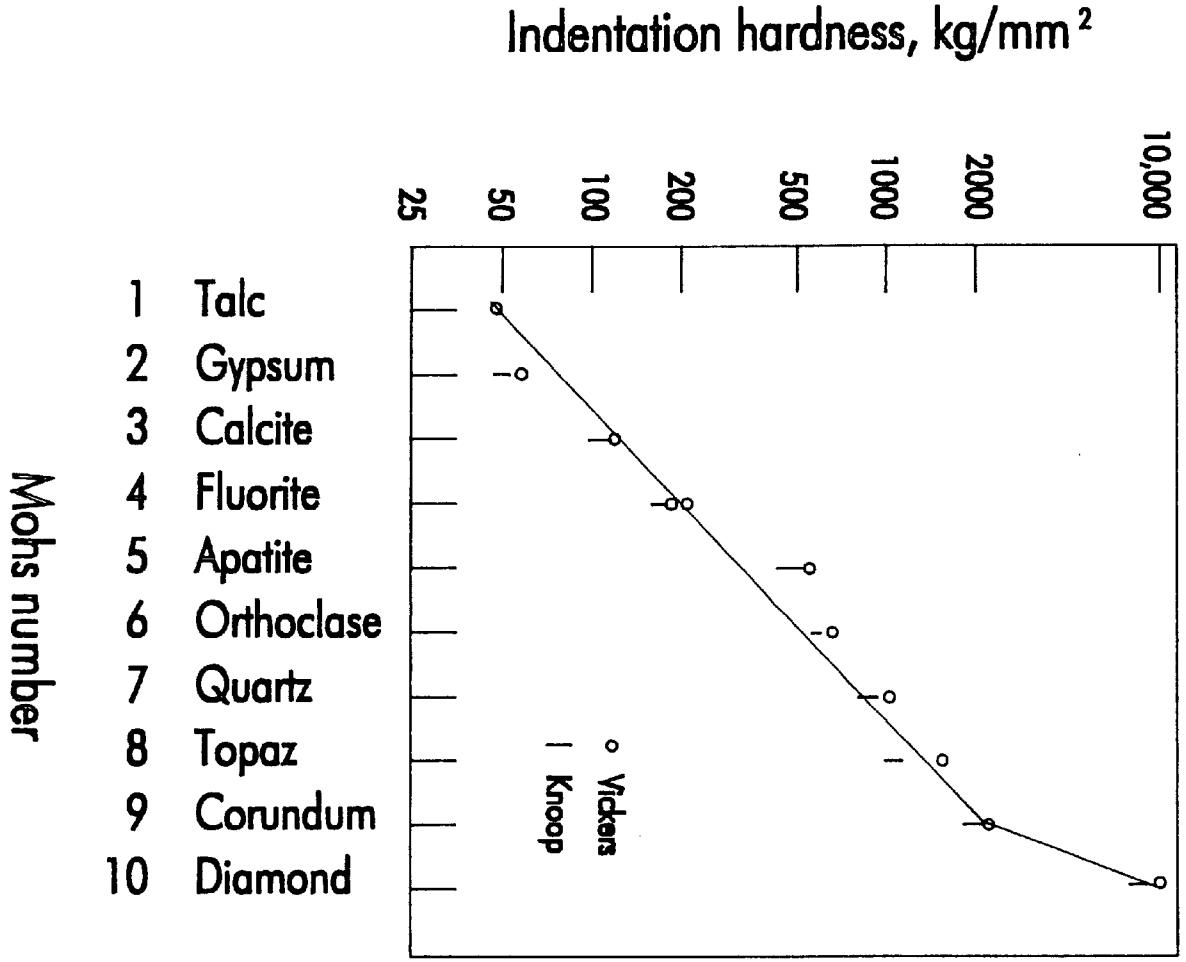
FIG. 4 is a graphical representation of the mohs number for particular minerals.

Abrasive wear results when two or more bodies of different hardness are rubbed together. Asperities in the harder material act like small cutters that plastically gouge chips from the softer material. Abrasive wear strongly depends on material hardness which is directly proportional to the yield strength of the material and which is ranked by a number of precisely defined scales. The Moh's scale which is used mostly by geologists to describe the hardness of various minerals and for that reason is interesting for drilling rock is shown in FIG. 4 with other scales for comparison. It should be noted that the Moh's scale is non-linear but interesting because certain minerals have convenient values, most notably diamond which has a value of 10 and quartz which has a value of 7. When a material is chosen to cut or remove another material it must be much harder than the material it will be removing. Diamond (Moh's hardness=10) and tungsten carbide, (Moh's hardness>9) are used almost exclusively to remove rock which often has a hardness of 7, quartz (sand).

In the case of a drag bit, diamond cutters backed with tungsten carbide scrape along a rock surface removing the material. In this process, the harder rock minerals, most importantly, quartz, are surprisingly capable of blunting diamond and tungsten carbide even though these minerals are significantly softer than diamond and tungsten carbide.

Lee and Hibbs (1978) explain how quartz and other rock minerals are able to wear polycrystalline diamond. They found that the diamond was removed by a small scale microfracturing process which was characterized by the dislodging and pulling out of individual diamond grains. This process continues until eventually relatively large wear flats form which, in turn, are capable of degrading cutter performance.

According to Glowka, et al. (1984), heat generated by friction between the rock and cutter at the wear flat removes the cobalt (Co) in the WC substrate directly behind the diamond. Once the Co, which to some extent binds the tungsten carbide, is removed tungsten carbide fracturing quickly follows. This leads to diamond table fracture because of the lack of support for the diamond table against drilling induced loading. This heat related mechanism operates in tandem with the diamond microfracturing mechanism described by Lee and Hibbs.

The end result is that rock minerals that are significantly softer than both diamond and tungsten carbide can cause significant wear to the cutting tool. If drilling parameters are chosen that generate a lot of heat, for example high weight, high rotary speed or both; or if the formation to be drilled has a high quartz (sand) content this wear can proceed at a very fast pace, indeed.

In addition to hardness, the shape of the quartz grains and how tightly these grains are held in place (how strong the formation is) are thought to play a role in abrasiveness. Angular quartz grains that are firmly held in place are felt to be more abrasive than round ones that are loose. Goodman, et al. (1997) has postulated that the internal angle of friction of a sand or sandstone formation is a direct measure of the formation abrasiveness and related to rock strength. The hard proof of this is still outstanding though circumstantial evidence seems to confirm the idea.

Plumb (1994) has demonstrated that internal friction can be estimated from rock porosity and other measures making it possible to estimate abrasion potential from log data. We also have the ability to estimate unconfined compressive strength from sonic transit times. Given UCS and internal angle of friction it is possible to calculate an 'insitu' strength.

Assuming the above to be true, it seems reasonable that the initial abrasion index could depend on formation constituent mineral hardness as determined by sand content and strength as determined by insitu or confined compressive strength. Sand content is determined by the lithology recognizer directly and will serve as an input to the abrasion index. 'Insitu' formation strength is determined by the UCS and internal angle of friction. More will be said about how these are calculated and interpreted later. In summary Table 1 in describes in broad overview our strategy for the abrasion index.

The Meaning of 'INSITU' Strength

Unconfined compressive strength (UCS) can be calculated from sonic transit time and lithology data. This was chosen because it is simple. Some in the industry claim to calculate 'insitu' strength, but then are unclear when explaining exactly what they have calculated. We feel that 'insitu' strength can be meaningful, particularly for an abrasion index but one has to be clear with regard to how it was calculated and what it means.

Rock failure is often described using the Mohr Coulomb failure criteria. Accordingly, failure strength is not one value, but increases as the confining pressure on the fabric of the rock increases. It follows that in the drilling environment the strength of the rock being drilled will depend on the stresses applied to the rock by its surroundings. This includes pressure from the mud column, stresses induced by the cutter, stresses induced by the lithostatic column of rock, possibly stress concentration factors resulting from the bore hole and stresses induced by the formation pressure. It is further complicated by the fact that some of these stresses can vary with time and the advance of the drill bit. For example, the pore pressure will increase as filtrate from the mud invades the pore space of the soon to be drilled rock.

Because of the above, calculating the 'insitu' rock strength right at the cutter is very difficult although some researchers have looked at parts of the problem. Galle and Wilhoit (1961) calculate the stress concentration factors resulting from a bore hole in a semi-infinite half space, and Warren and Smith (1985) discuss the changes that occur in effective stress in a non permeable rock (shale) as a bore hole approaches from above. Hanson and Tibbitts (1991) discuss the rate of mud filtration at the bore hole boundary and its affect on effective stress and finally Kolle (1993) discusses how rock porosity and permeability and the loading rate of the cutter can lead to dynamic confining or strengthening.

Figure 5:
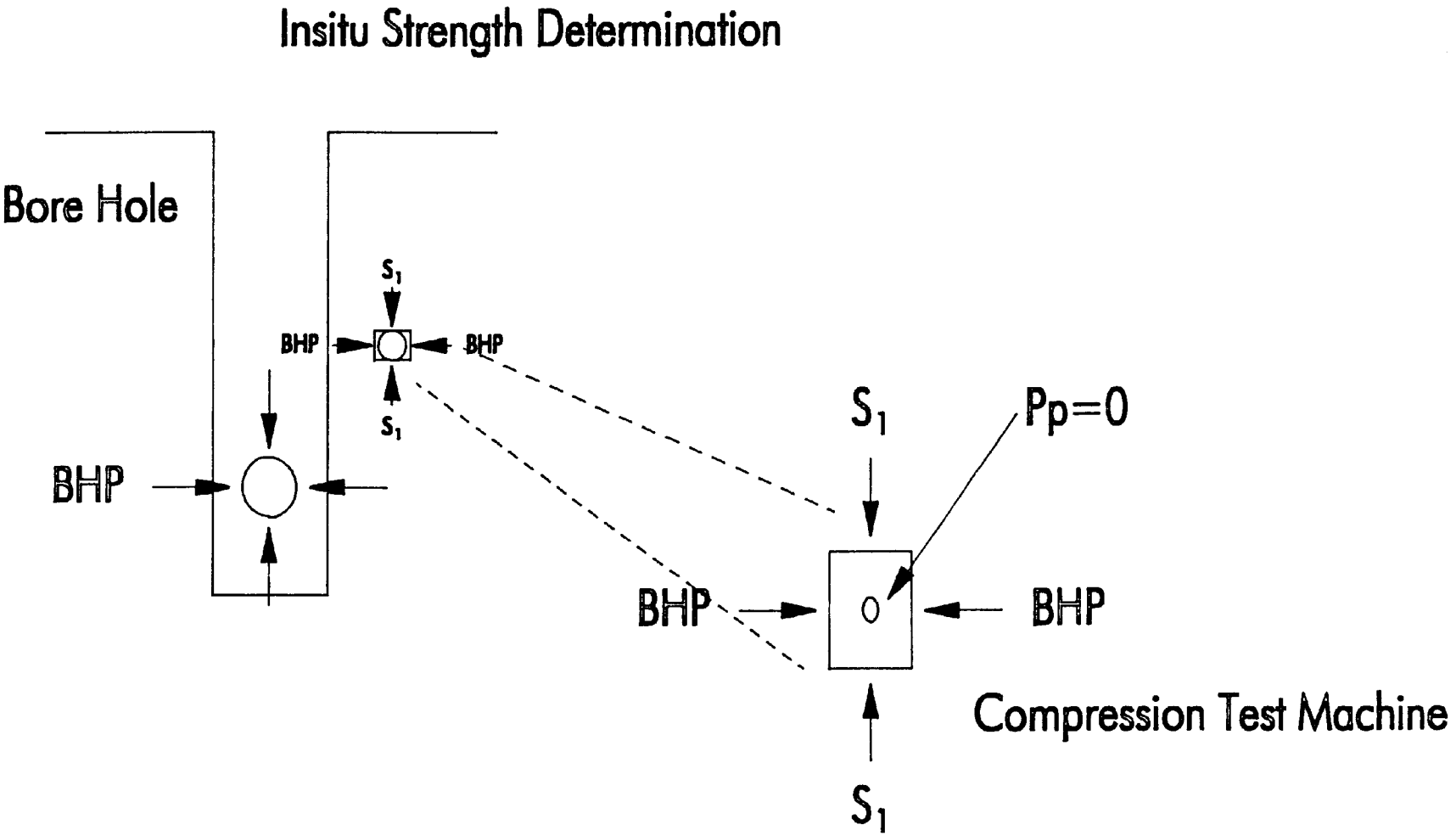
FIG. 5 is a graphical representation of the methodology utilized to determine insitu strength.

For simplicity, we have elected to calculate the strength of the rock at the side of the bore hole and at least one bore hole diameter away from the bottom as shown in FIG. 5. We have decided to calculate the 'insitu' stress value that corresponds to the strongest the rock at this location could potentially become by assuming that the effective confining stress (the stress on the rock fabric that strengthens the rock) is equivalent to the total bottom hole pressure. Finally, we have elected to ignore the effects that the cutting process would have on the potential strengthening or weakening of the rock. As assumed above, this estimated 'insitu' strength value corresponds to the value one would measure in a compression test machine as described below with the confining stress set equal to the bottom hole pressure.

Calculating 'INSITU' Strength

Our goal is to calculate 'insitu' strength as a function of the parameters that we know from wire line logs, mud weight and depth. Before doing so it is informative to understand a few of the fundamentals of rock testing.

Rock Failure Strength Determination

'Insitu' rock strength is normally determined by performing a suite of compression tests on right circular rock samples. The goal is to perform one or more tests at a number of confining pressures and by so doing obtain a value for the strength of the rock at each confining stress. These data are then plotted according to an accepted failure theory such as Mohr Coulomb.

Figure 6:
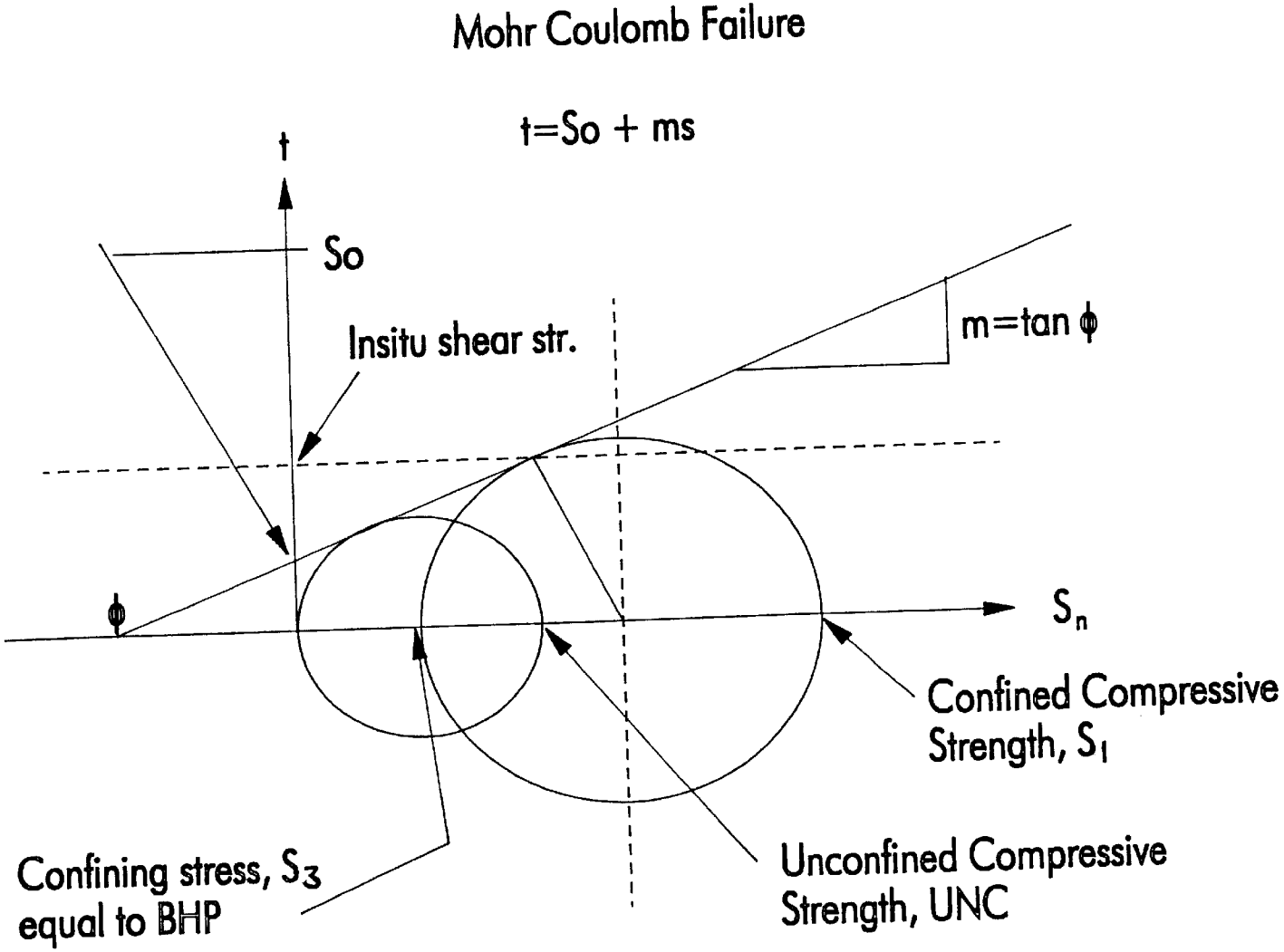
FIG. 6 is a graphical representation of the mohr coulomb failure.

Mohr Coulomb failure theory is represented in shear stress—normal stress space. FIG. 6 illustrates a typical plot of two triaxial compression tests. The confining stress, $s^3$, (we assume this equal to the Bottom Hole Pressure, BHP) and the compressive stress at failure $s^1$ are plotted on the horizontal axis and a circle of diameter $s^1-s^3$ is drawn with the center at $(s^1+s^3)/2$. This is done for each test. A line is then drawn as closely as possible tangent to the circles as shown in FIG. 6. Stress states below this line are safe and above this line are failure. The slope is equal to the tangent of the angle of internal friction, $\phi$. Large angles of internal friction mean that this line is steep and imply that the rock strengthens significantly with confining stress. The shear value corresponding to the tangent point of the circle and line represents the 'insitu' shear strength for the stress state represented by that particular circle. The line's intercept with the vertical axis is called the cohesion and represents the shear strength of the rock in a direct shear test. This is different from the unconfined compression strength which corresponds to the $s^1$ value for a test conducted at zero confining pressure.

As mentioned above, sonic velocities and lithology have been shown to correlate with the unconfined compressive strength and rock porosity and other measures have been shown to correlate with the angle of internal friction. Knowing these two parameter it is possible to construct a Mohr Coulomb failure diagram and calculate the rock strength for any stress state, or in other words, calculate an estimate of 'insitu' strength. The 'insitu' strength we will be calculating corresponds to $s^1$ in FIG. 6.

Calculation

Figure 7:
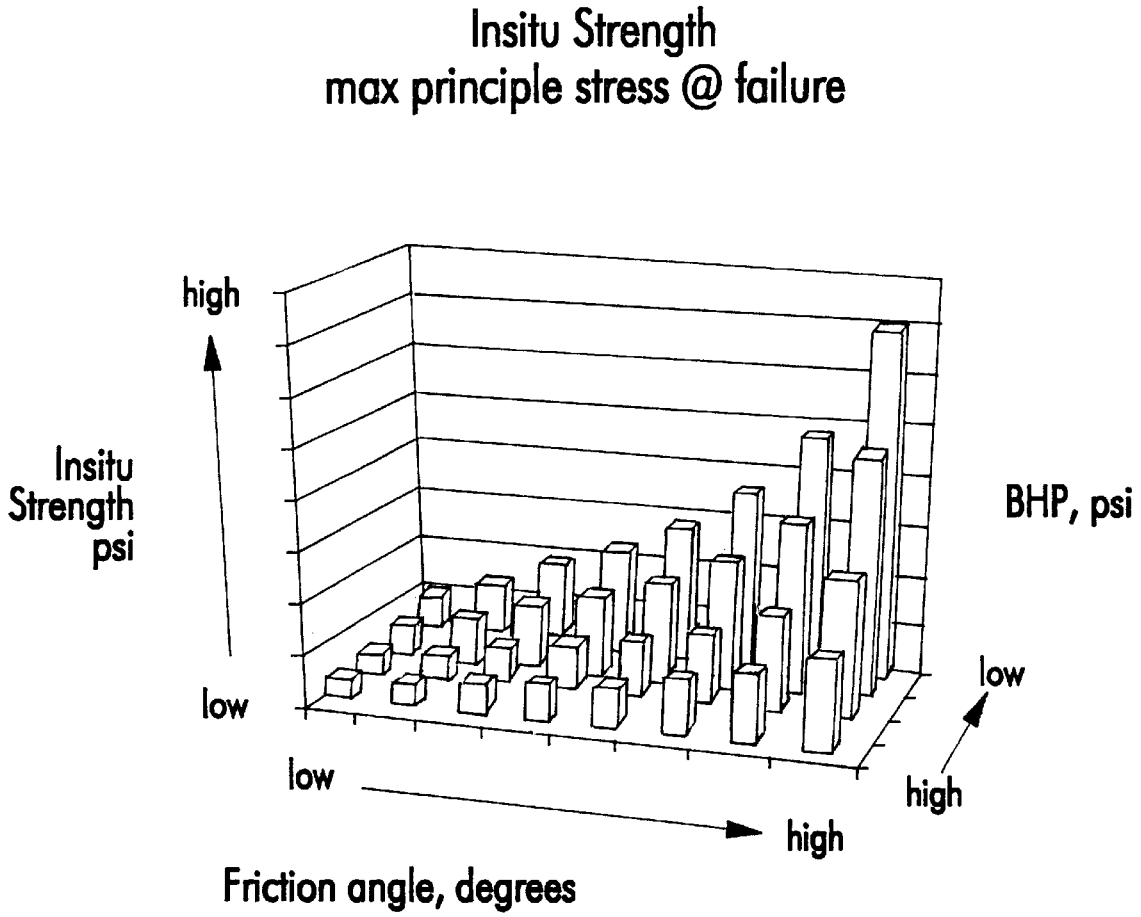
FIG. 7 is a three-dimensional graphical representation of insitu strength in psi, friction angle in degrees, and bottomhole pressure in psi.

For the purposes of routine calculation it is more convenient to recast $s^1$ (confined compressive strength) into a function of confining stress, friction angle, and cohesion. We have done this and the equation in FIG. 7 is the result. Our calculation, estimates maximum rock strength sets confining pressure equal to bottom hole pressure, estimates the friction angle from porosity and estimates the unconfined compressive strength from sonic velocities and the lithology identifier. A plot of what the confined compressive strength is for a range friction angle and bottomhole pressure values is shown in FIG. 7.

Describing the Rule Matrix

There is no 'right and only' method for constructing or calculating the abrasivity index. The goal is to provide a warning if their is a potential of abrasivity and the basis for calculating that warning or index is solely based on past experience. The calculation should be readily modifiable if new or different experience is gained in the future. For simplicity the two parameters discussed above were decided on: sand content and strength. A rule matrix was constructed as shown in FIG. 8. Here, the main parameters are 'insitu' strength which is calculated as described above and which takes on the values of High Strength, HS; Medium Strength, MS; and Low Strength, LS. Sand content which is extracted from the lithology identifier takes on the values of No Sand, NS; Low Sand, LS, Medium Sand, MS; and High Sand, HS. These independent variables are mapped into the abrasive index variables which are determined by the rule matrix and which can take on the values No Abrasion, NA; Low Abrasion, LA; Medium Abrasion, MA; and High Abrasion, HA. This rule set is our first guess and subject to further improvement.

Fuzzy Set Methods

Figure 9:
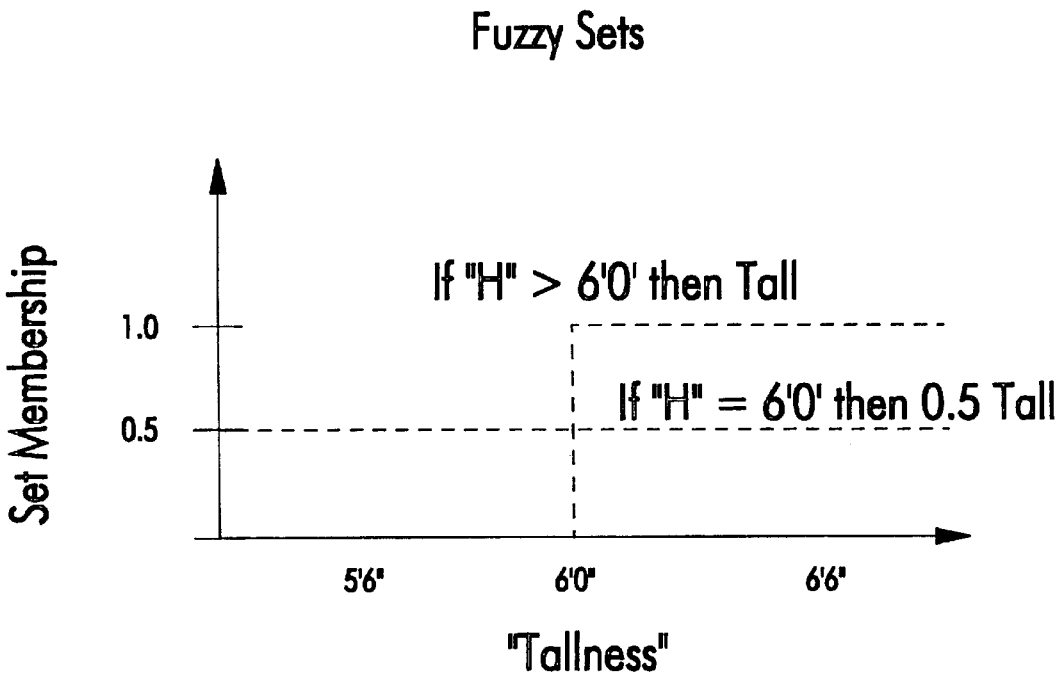
FIG. 9 is a graphical representation of the concept of fuzzy set membership.

Fuzzy methods can be described using FIG. 9. In this example, tallness set membership is plotted versus height. One might ask: "when is a person considered tall?". A crisp answer might be stated as, "if height equal to or greater than 6'0" then tall". What if a person is 5'11?" Is he then short? The all or nothing aspect of crisp values is in this case unsatisfactory.

Using fuzzy set theory the following statement would be made, "if height equal to 6'0" then 0.5 tall". The person belongs 50% to the tallness set and presumably 50% to the shortness set. A person 6'3" tall would belong approximately 75% to the tallness set and so forth.

Figure 10:
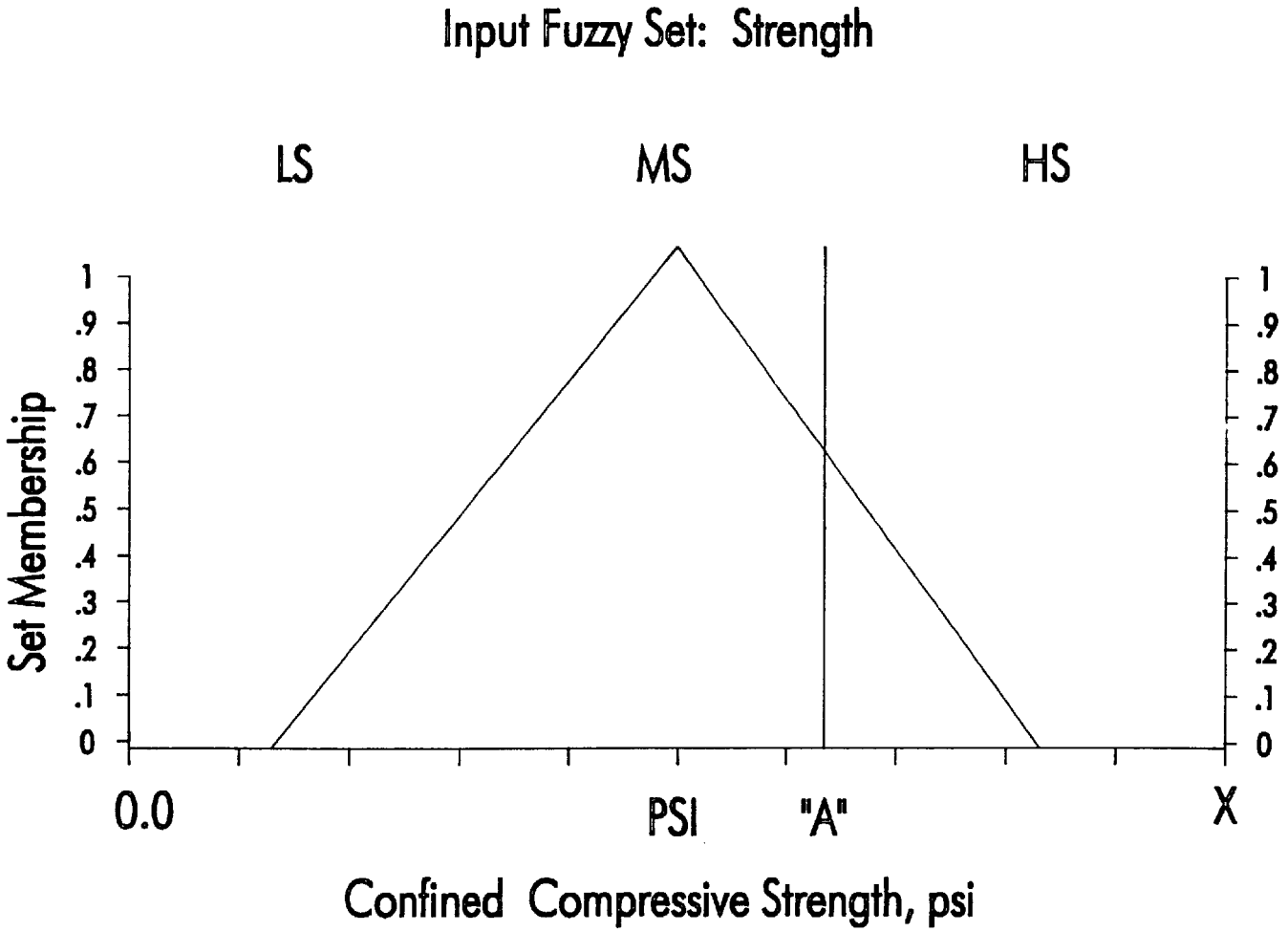
FIG. 10 is a graphical representation of set membership versus confined compressive strength in psi.
Figure 11:
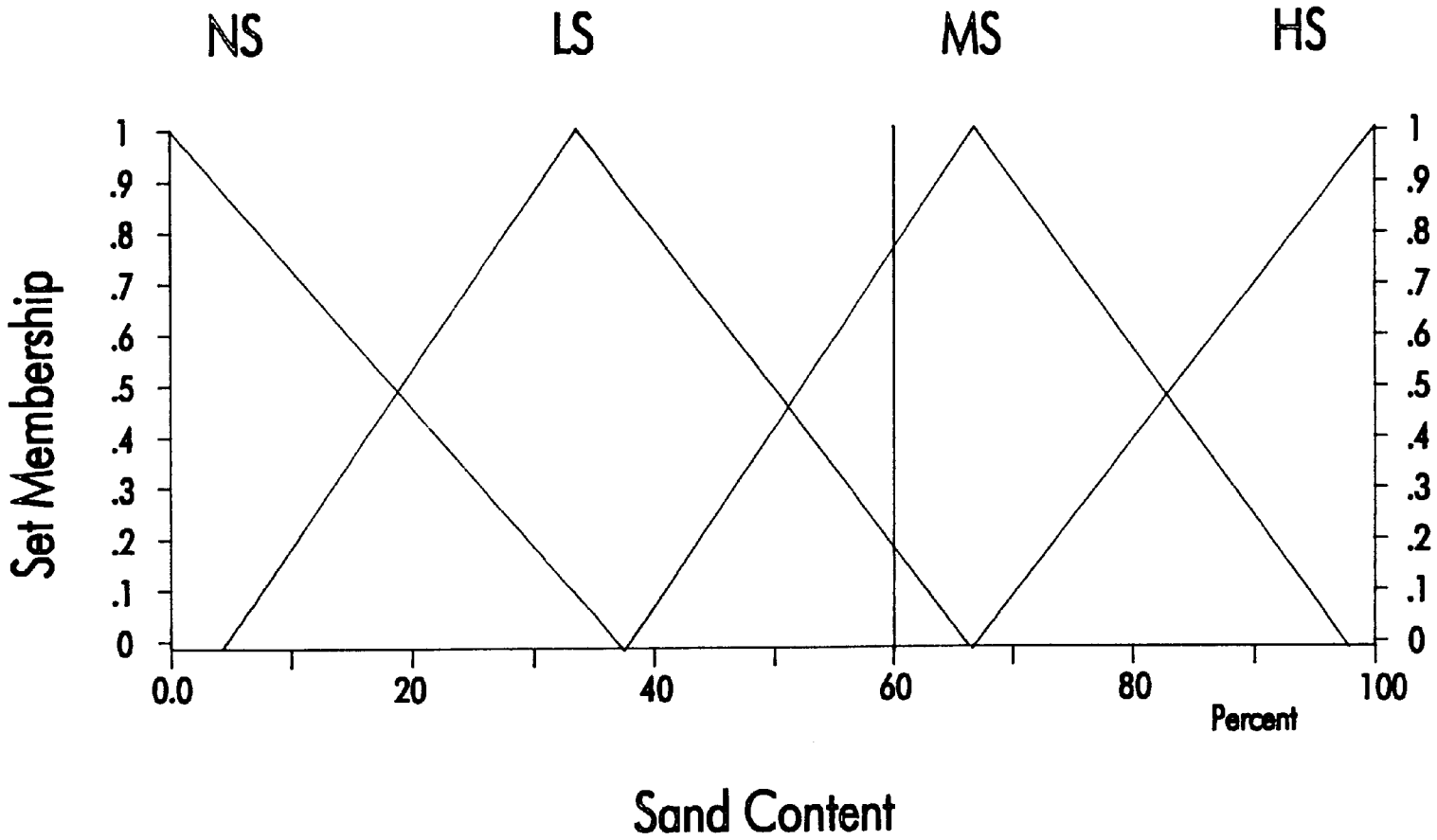
FIG. 11 is a graphical representation of set membership versus sand content.

FIGS. 10 and 11 depict the fuzzy sets that have been constructed for confined compressive strength and sand content and make possible the transformation of a crisp value taken from a log into the linguistic variables described above. For example, let us assume we have a UCS reading of "A" and a sand content of "60%" psi. From FIG. 10 it can be seen that a strength of "A" belongs about 60% to the medium strength "MS" set and about 40% to the high strength, "HS" set. Similar considerations for sand content would show 80% membership to the medium sand, 'MS' set and about 20% membership to the low sand 'LS' set.

Figure 12:
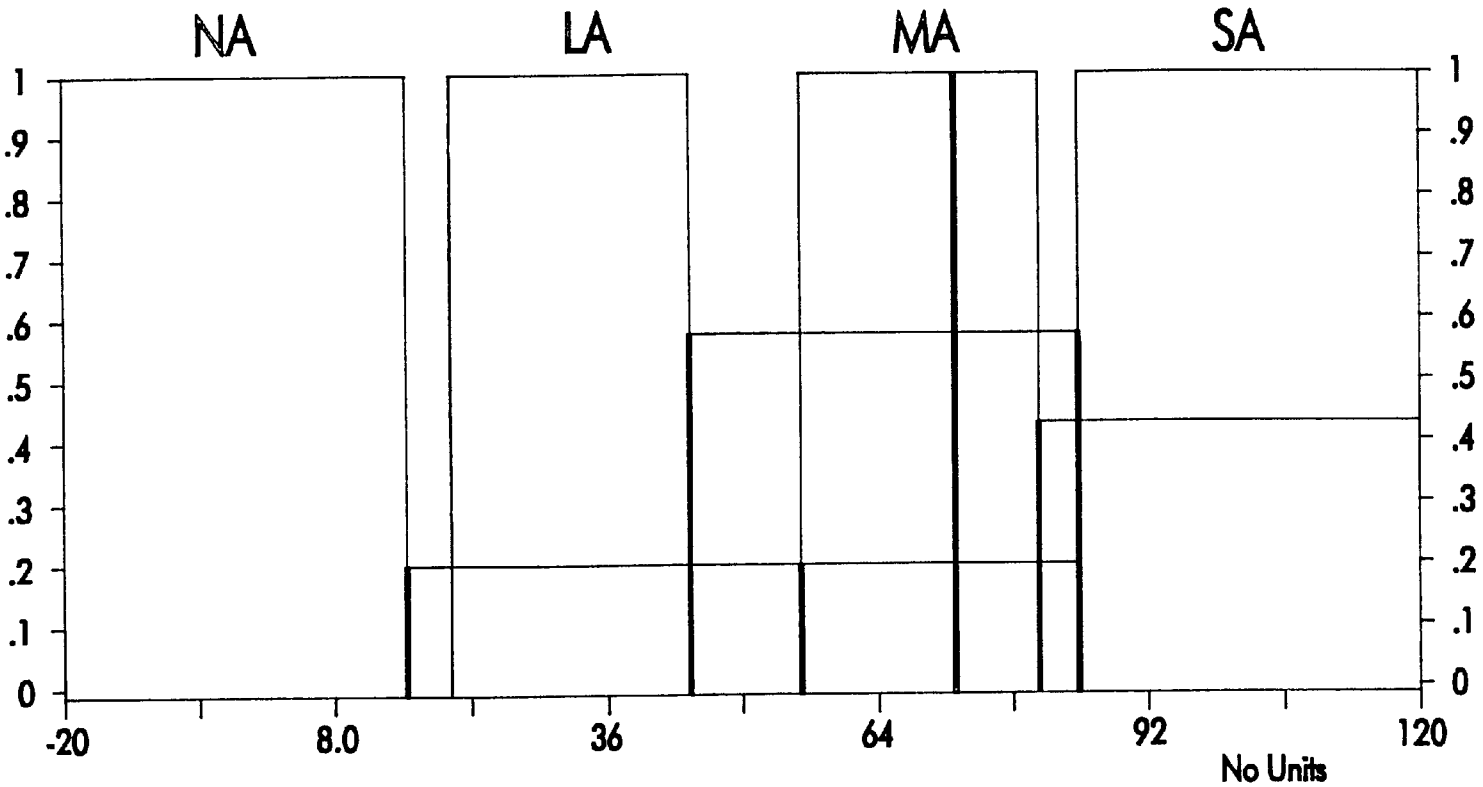
FIG. 12 is a graphical representation of the defuzzification of the abrasivity index.

Each combination of strength and sand content sets forms an input pair. Not all the rules, however, are fired with the same intensity. The degree of firing depends on the minimum set membership value of each pair. Defuzzifying the four minima is accomplished with an output fuzzy set that for our example is shown in FIG. 12. There is a bar or set for each severity of abrasivity ("NA" for no abrasion; "LA" for low abrasivity; "MA" for moderate abrasivity; and "SA" for severe abrasivity). The height of each bar ranges from '0' to '1' and is determined by the values of the four minima. This is illustrated in FIG. 12. These sets are then geometrically combined and the centroid of the result geometric area calculated. The value of this centroid represents the defuzzified balling index of 0.5 as shown in FIG. 12.

Calculating the abrasivity index using the above rule set and the fuzzy set methods for all combinations of strength and sand content results in the response surface which should be smooth and 'well behaved'.

If experience should show that the abrasivity index is not accurate, modification is done simply by changing the rule matrix to more closely agree with the new experience. Of course the assumption, here, is that strength and sand content are the most influential parameters that describe balling abrasivity. If another variable is found to be more or as important it could either replace one of the above or be added into the scheme by using additional rule matrices. Care must be taken, however, since each new variable dramatically increases the number of rules that must be calibrated.

Example Well, Baker Hughes Experimental Test Area, Beggs, Oklahoma

Baker Hughes operates an experimental drilling facility in Beggs, OK about 30 miles southwest of Tulsa. The formations have been extensively logged to about 3000 feet vertical depth. Because the well is shallow calculated abrasivity will be primarily a function of sand content.

Figure 13:
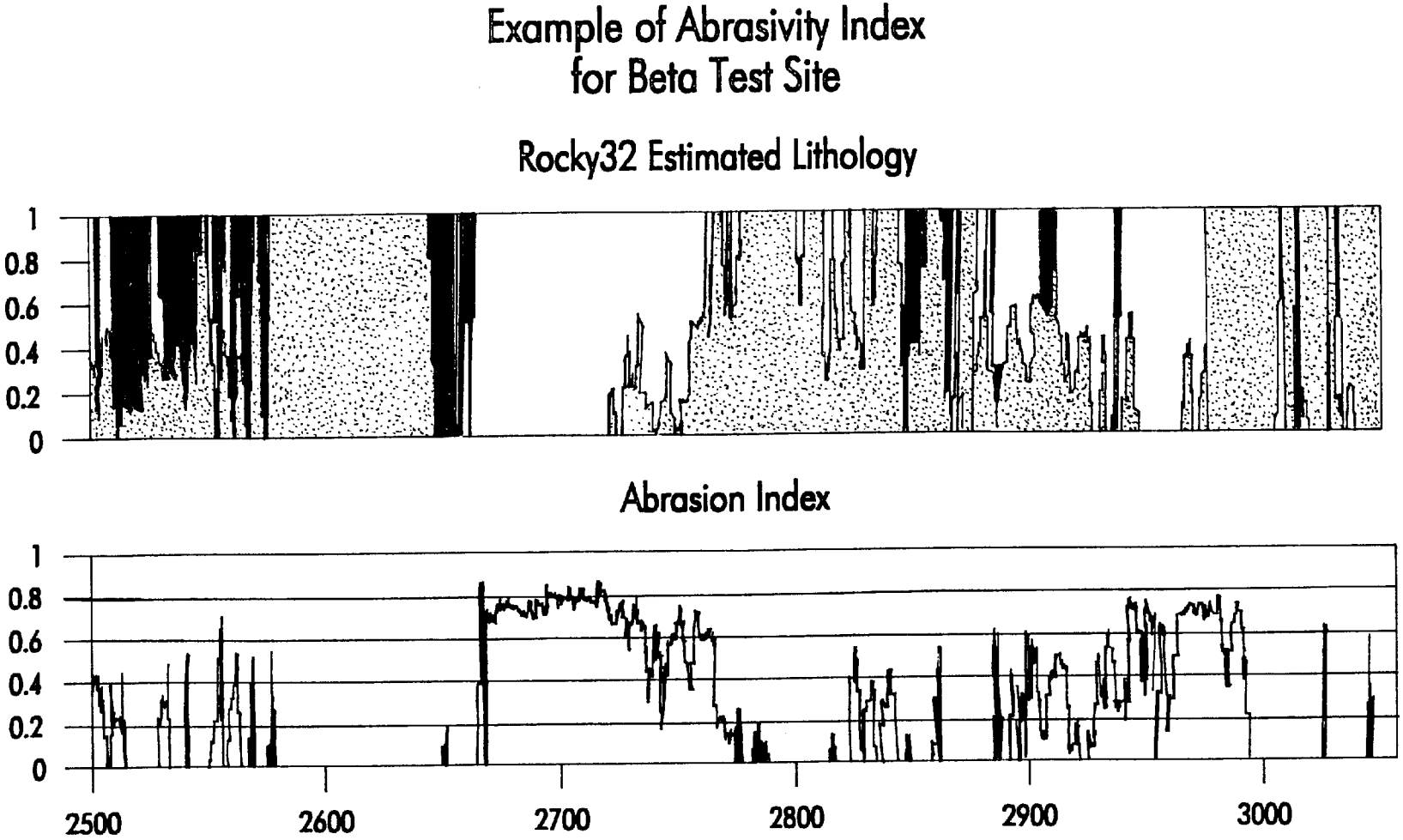
FIG. 13 is a pictorial representation of test results for a test well.

The calculation was performed for known abrasive formations scattered through the interval of 2500–3000 feet. The results are shown and correlated with lithology in FIG. 13. As can be seen the abrasivity index does jump to values above 0.5 when the sand content is high. Obviously, more field calibrations at greater depth need to be performed.

Figure 14:
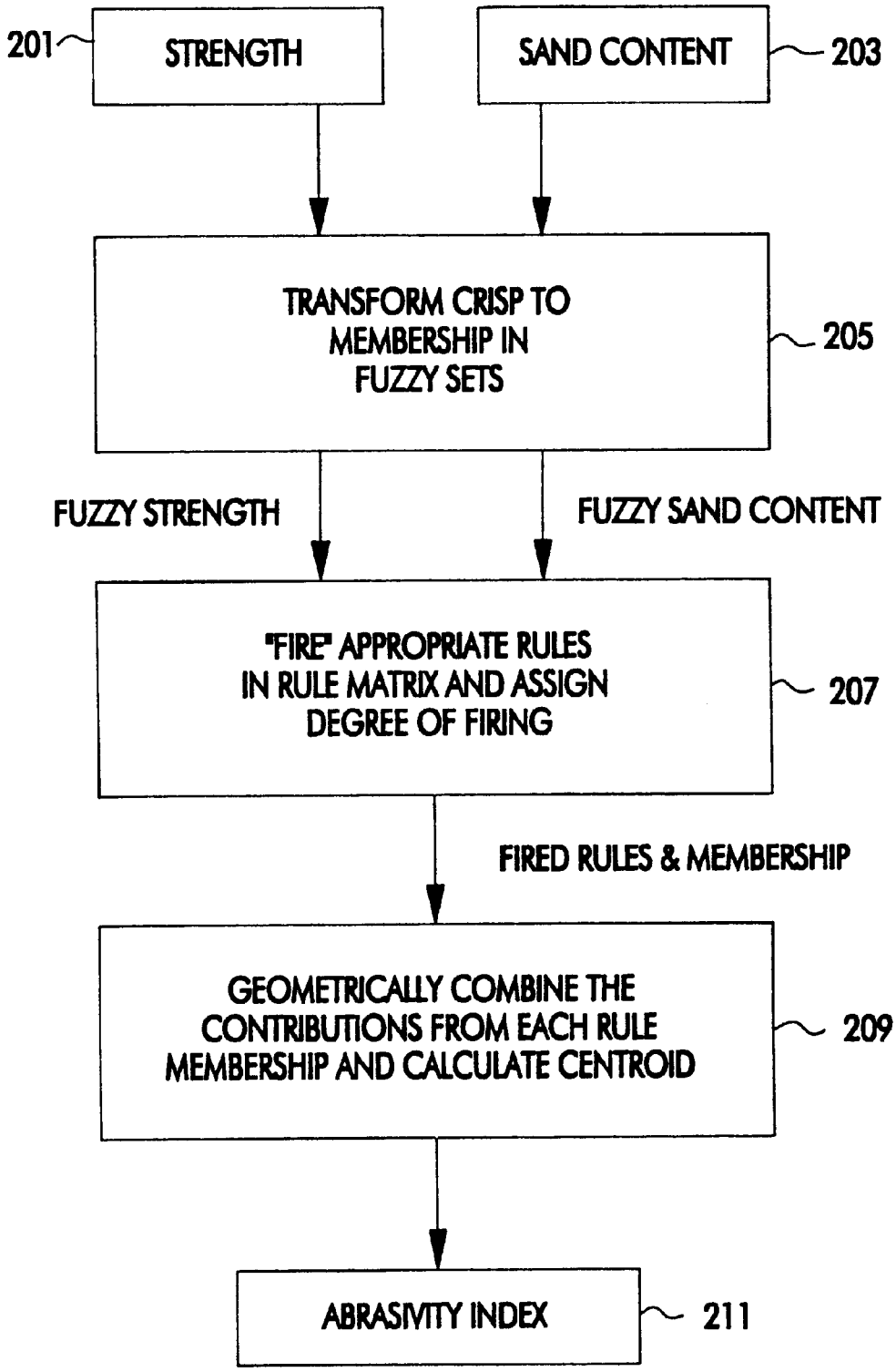
FIG. 14 is a flowchart representation of the preferred embodiment of the computer program.

FIG. 14 is a flowchart representation of the preferred embodiment of the computer program of the present invention. As is shown, the computer program receives inputs 201, 203. Input 201 is data which represents the strength of the formation (and which is based on forensic information), while input 203 represents the sand content of the likely formation. These are supplied as an input to block 205 which transforms the crisp memberships into memberships in fuzzy sets. The fuzzy strength information and fuzzy sand content information is provided as an input to block 207, which fires the appropriate rules in the rule matrix and the signs degree of firing. Next, in accordance with block 209, the contributions from each rule is geometrically combined to calculate a centroid. Then, in accordance with block 211, an abrasivity index is generated which provides the useful information.

Although the invention has been described with reference to a particular embodiment, this description is not meant to be construed in a limiting sense. Various modifications of the disclosed embodiments as well as alternative embodiments of the invention will become apparent to persons skilled in the art upon reference to the description of the invention. It is therefore contemplated that the appended claims will cover any such modifications or embodiments that fall within the scope of the invention.

What is claimed is:

1. A method of providing an indicator of potential for abrasive wear of a drill bit in a particular wellbore, comprising:

(a) obtaining forensic wellbore data from at least one previously drilled wellbore which is determined to be comparable to said particular wellbore;

(b) providing an inference engine computer program consisting of executable program instructions which includes a rule matrix, and which is adapted to utilize a plurality of wellbore parameters, including said forensic wellbore data;

(c) loading said inference engine computer program on to a data processing system;

(d) supplying as an input to said inference engine computer program said forensic wellbore data and at least one other of said plurality of wellbore parameters; and (e) utilizing said data processing system to execute program instructions of said inference engine computer program to apply said input to said inference engine computer program, with at least a portion of said input being supplied to said rule matrix, and to produce as an output an indicator of potential for abrasive wear of a drill bit in said particular wellbore.

2. The method of providing an indicator of potential for abrasive wear of a drill bit according to claim 1, further comprising:

(f) obtaining empirical wellbore data from said particular wellbore during drilling operations; and (g) additionally supplying said empirical wellbore data as an input to said inference engine computer program.

3. The method of providing an indicator of potential for abrasive wear of a drill bit according to claim 2, further comprising:

(h) wherein said indicator of potential for abrasive wear of a drill bit is generated repeatedly during drilling operations; and (i) wherein said indicator provides an indication of potential for abrasive wear of a drill bit before abrasive wear occurs.

4. The method of providing an indicator of potential for abrasive wear of a drill bit according to claim 3 further comprising:

(j) altering at least one drilling condition in response to said indicator in order to diminish the probability of abrasive wear of a drill bit occurring.

5. The method of providing an indicator of potential for abrasive wear of a drill bit according to claim 4, wherein said at least one drilling condition includes at least one of:

(1) mud type;

(2) bit type;

(3) bit hydraulic;

(4) rotary speed; and (5) weight on bit.

6. The method of providing an indicator of potential for abrasive wear of a drill bit according to claim 1, wherein said forensic wellbore data includes at least log data which indicates sand content.

7. The method of providing an indicator of potential for abrasive wear of a drill bit according to claim 1, wherein said forensic wellbore data includes at least one of:

(a) data which relates to sand content; and (b) data which relates to formation strength.

8. The method of providing an indicator of potential for abrasive wear of a drill bit according to claim 1, wherein said forensic wellbore data includes both of:

(a) data which relates to sand content; and (b) data which relates to formation strength.

9. The method of providing an indicator of potential for abrasive wear of a drill bit according to claim 1, wherein said forensic wellbore data includes both of:

(a) log data which provides an indication of likely and content at particular depths; and (b) log data which provides an indication of likely formation strength at particular depths.

10. The method of providing an indicator of potential for abrasive wear of a drill bit according to claim 9, wherein said data which provides an indication of likely formation strength at a particular depth comprises data which provides an indication of likely unconfined compressive strength of formations at particular depths.

11. The method of providing an indicator of potential for abrasive wear of a drill bit according to claim 1, wherein said indicator of potential for abrasive wear of a drill bit comprises a numerical indicator of potential for abrasive wear of a drill bit.

12. The method of providing an indicator of potential for abrasive wear of a drill bit according to claim 11, wherein said numerical indicator comprises a numerical value in the range between an upper boundary value and a lower boundary value.

13. A method of providing an indicator of potential for abrasive wear of a drill bit comprising:

(a) obtaining forensic wellbore data from at least one previously drilled wellbore which is determined to be comparable to said particular wellbore;

(b) providing a rule matrix computer program consisting of executable program instructions, and adapted to utilize a plurality of wellbore parameters, including said forensic wellbore data;

(c) loading said rule matrix computer program on to a data processing system;

(d) supplying as an input to said rule matrix computer program said forensic wellbore data and at least one other of said plurality of wellbore parameters; and (e) utilizing said data processing system to execute program instructions of said rule matrix computer program to apply said input to said rule matrix computer program and to produce as an output an indicator of potential for abrasive wear of a drill bit in said particular wellbore.

14. The method of providing an indicator of potential for abrasive wear of a drill bit according to claim 13, wherein said rule matrix establishes correspondence between said plurality of wellbore parameters and said indicator.

15. The method of providing an indicator of potential for abrasive wear of a drill bit according to claim 13, wherein said rule matrix defines a plurality of fuzzy sets.

16. The method of providing an indicator of potential for abrasive wear of a drill bit according to claim 15, wherein said each of said fuzzy sets is identified to at least one corresponding membership function.

17. The method of providing an indicator of potential for abrasive wear of a drill bit according to claim 16, wherein collectively said fuzzy sets define a responsive surface which relates said plurality of wellbore parameters to said indicator of potential for abrasive wear of a drill bit.

18. The method of providing an indicator of potential for abrasive wear of a drill bit according to claim 13:

wherein said rule matrix is composed of a plurality of qualitative descriptions for each said plurality of wellbore parameters; and wherein each of said plurality of qualitative descriptions has a numerical value associated therewith;

wherein said inference engine computer program combines the effects of said plurality of wellbore parameters through said indicator of potential for abrasive wear of a drill bit in said particular wellbore.

19. The method of providing an indicator of potential for abrasive wear of a drill bit according to claim 18, wherein said numerical value which is associated with each of said plurality of qualitative descriptions is adjustable in order to allow modification of said inference engine.

20. The method of providing an indicator of potential for abrasive wear of a drill bit according to claim 19, wherein said numerical value which is associated with each of said plurality of qualitative descriptions is adjustable in order to allow modification of said inference engine, in order to allow calibration of a response surface which defines a universe of possible values for said indicator of potential for abrasive wear of a drill bit.

21. An apparatus for providing an indicator of potential for abrasive wear of a drill bit in a particular wellbore, comprising:

(a) a data processing system adapted for execution of program instructions;

(b) an inference engine computer program composed of executable program instructions, and including:

(1) an inference engine program module which includes a rule matrix which establishes correspondence between a plurality of wellbore parameters and an indicator of potential for abrasive wear of a drill bit and which combines the effects of at least two distinct wellbore parameters utilizing said rule matrix in order to produce as an output an indicator of potential for abrasive wear of a drill bit; and (2) an input program module for receiving data corresponding to at least two of said plurality of wellbore parameters and supplying said data to said inference engine program module.

22. The apparatus for providing an indicator of potential for abrasive wear of a drill bit according to claim 21, wherein said inference engine further includes:

(3) an output program which provides in a human-readable format said indicator of potential for abrasive wear of a drill bit.

23. The apparatus for providing an indicator of potential for abrasive wear of a drill bit according to claim 22, wherein said indicator for potential abrasive wear of a drill bit is presented in human-readable format of a single numeric value from a range of available numeric values between an upper numeric limit and a lower numeric limit.

24. The apparatus for providing an indicator of potential for abrasive wear of a drill bit according to claim 21, wherein said inference engine computer program further includes:

(3) program instructions for recursively computing said indicator of potential for abrasive wear of a drill bit during drilling operations.

25. The apparatus for providing an indicator of potential for abrasive wear of a drill bit according to claim 21, wherein said input program module of said inference engine computer program comprises:

(2) an input program module for receiving data corresponding to at least two following distinct wellbore parameters:

(a) forensic wellbore data from at least one previously drilled wellbore which is determined to be comparable to a subject wellbore; and (b) empirical wellbore data related to said subject wellbore; and for supplying said data to said inference engine program module.

26. The apparatus for providing an indicator of potential for abrasive wear of a drill bit according to claim 21, wherein said inference engine program module includes a rule matrix which establishes correspondence between the two following distinct wellbore parameters:

(a) forensic wellbore data from at least one previously drilled wellbore which is determined to be comparable to a subject wellbore; and (b) other wellbore data related to said subject wellbore; and and an indicator of potential for abrasive wear of a drill bit, by combining the effects of the forensic wellbore data and the other wellbore data utilizing said rule matrix in order to produce as an output and indicator of potential for abrasive wear of a drill bit of said subject wellbore.

27. A method of drilling a wellbore, comprising:

(a) obtaining forensic wellbore data from at least one previously drilled wellbore which is determined to be comparable to a target wellbore;

(b) providing an inference engine computer program consisting of executable program instructions which includes a rule matrix, and which is adapted to utilize a plurality of wellbore parameters, including said forensic wellbore data;

(c) loading said inference engine computer program on to a data processing system;

(d) supplying as an input to said inference engine computer program said forensic wellbore data and at least one other of said plurality of wellbore parameters;

(e) utilizing said data processing system to execute program instructions of said inference engine computer program to apply said input to said inference engine computer program, with at least a portion of said input being supplied to said rule matrix, and to produce as an output an indicator of potential for abrasive wear of a drill bit in said target wellbore;

(f) providing a plurality of available rock bits for use in drilling particular portions of said target wellbore, with particular ones of said plurality of available rock bits having different resistance to abrasive wear which corresponds generally to said indicator of potential for abrasive wear of a drill bit;

(g) selecting a particular one of said plurality of available rock bits based at least in part upon said potential for abrasive wear of a drill bit as predicted by said indication of potential for abrasive wear of a drill bit;

(h) connecting said particular one of said plurality of available rock bits to a drilling string; and (i) performing drilling operations.

28. The method drilling a wellbore according to claim 27, further comprising:

(j) obtaining empirical wellbore data from said target wellbore during drilling operations; and (k) additionally supplying said empirical wellbore data as an input to said inference engine computer program.

29. The method of drilling a wellbore according to claim 27, wherein said forensic wellbore data includes at least log data relating to formation types.

30. The method of drilling a wellbore according to claim 27, wherein said forensic wellbore data includes at least one of:

(a) data which relates to sand content; and (b) data which relates to formation strength.

31. The method of drilling a wellbore according to claim 27, wherein said forensic wellbore data includes both of:

(a) data which relates to sand content; and (b) data which relates to formation strength.

32. The method of drilling a wellbore according to claim 27, wherein said forensic wellbore data includes both of:

(a) log data which provides an indication of likely sand content at particular depths; and (b) log data which provides an indication of likely formation strength at particular depths.

33. The method of drilling a wellbore according to claim 32, wherein said data which provides an indication of likely formation strength at a particular depth comprises data which provides an indication of likely unconfined compressive strength of formations at particular depths.

34. The method of drilling a wellbore according to claim 27, wherein said indicator of potential for abrasive wear of a drill bit comprises a numerical indicator of potential for abrasive wear of a drill bit.

35. The method of drilling a wellbore according to claim 34, wherein said numerical indicator comprises a numerical value in the range between an upper boundary value and a lower boundary value.

36. The method of drilling a wellbore according to claim 27, further comprising:

(l) wherein said indicator of potential for abrasive wear of a drill bit is generated repeatedly during drilling operations; and (m) wherein said indicator provides an indication of potential for abrasive wear of a drill bit before drilling occurs.

37. The method of drilling a wellbore according to claim 36, further comprising:

(n) altering at least one drilling condition in response to said indicator in order to diminish the probability of abrasive wear of a drill bit occurring.

38. The method of drilling a wellbore according to claim 37, wherein said at least one drilling condition includes at least one of:

(1) mud type;

(2) bit type;

(3) bit hydraulics;

(4) rotary speed; and (5) weight on bit.

39. A method of drilling a wellbore, comprising:

(a) obtaining forensic wellbore data from at least one previously drilled wellbore which is determined to be comparable to a target wellbore;

(b) providing an inference engine computer program consisting of executable program instructions, and adapted to utilize a plurality of wellbore parameters, including said forensic wellbore data said inference engine comprising a rule matrix;

(c) loading said inference engine computer program on to a data processing system;

(d) supplying as an input to said inference engine computer program said forensic wellbore data and at least one other of said plurality of wellbore parameters;

(e) utilizing said data processing system to execute program instructions of said inference engine computer program to apply said input to said inference engine computer program and to produce as an output an indicator of potential for abrasive wear of a drill bit in said target wellbore;

(f) providing a plurality of available rock bits for use in drilling particular portions of said target wellbore, with particular ones of said plurality of available rock bits having different resistance to abrasive wear which corresponds generally to said indicator of potential for abrasive wear of a drill bit;

(g) selecting a particular one of said plurality of available rock bits based at least in part upon said potential for abrasive wear of a drill bit as predicted by said indication of potential for abrasive wear of a drill bit;

(h) connecting said particular one of said plurality of available rock bits to a drilling string; and (i) performing drilling operations.

40. The method of drilling a wellbore according to claim 39, wherein said rule matrix establishes correspondence between said plurality of wellbore parameters and said indicator.

41. The method of drilling a wellbore according to claim 39, wherein said rule matrix defines a plurality of fuzzy sets.

42. The method of drilling a wellbore according to claim 41, wherein said each of said fuzzy sets is identified to at least one corresponding membership function.

43. The method of drilling a wellbore according to claim 42, wherein collectively said fuzzy sets define a responsive surface which relates said plurality of wellbore parameters to said indicator of potential for abrasive wear of a drill bit.

44. The method of drilling a wellbore according to claim 39:

wherein said rule matrix is composed of a plurality of qualitative descriptions for each said plurality of wellbore parameters; and wherein each of said plurality of qualitative descriptions has a numerical value associated therewith; and wherein said inference engine computer program combines the effects of said plurality of wellbore parameters through said indicator of potential for abrasive wear of a drill bit in said target wellbore.

45. The method of drilling a wellbore according to claim 44, wherein said numerical value which is associated with each of said plurality of qualitative descriptions is adjustable in order to allow modification of said inference engine.

46. The method of drilling a wellbore according to claim 45, wherein said numerical value which is associated with each of said plurality of qualitative descriptions is adjustable in order to allow modification of said inference engine in order to allow calibration of a response surface which defines a universe of possible values for said indicator of potential for abrasive wear of a drill bit.

* * * * *